US005488361A

United States Patent [19]

Perry

[11] Patent Number: 5,488,361

[45] Date of Patent: Jan. 30, 1996

[54] NAVIGATION LIGHTS FOR PERSONAL WATERCRAFT OPERATOR

[76] Inventor: Joseph W. Perry, 1650 Amate, La Habra Heights, Calif. 90631

[21] Appl. No.: 291,604

[22] Filed: Aug. 16, 1994

[51] Int. Cl.[6] ..... G08B 23/00

[52] U.S. Cl. ..... 340/984; 340/573; 340/985; 362/103; 362/105

[58] Field of Search ..... 340/984, 985, 340/539, 573, 427, 475; 116/26; 114/270; 440/2; 441/13, 17, 89, 106; 362/103, 105, 108

[56] References Cited

U.S. PATENT DOCUMENTS

| | | | |
|---|---|---|---|
| 2,361,414 | 10/1944 | Ramsey | 240/6.4 |
| 2,674,726 | 4/1954 | Williams | 340/985 |
| 3,153,745 | 10/1964 | Gurian et al. | 362/103 |
| 3,621,501 | 11/1971 | Jordan | 441/89 |
| 3,720,918 | 3/1973 | Perl | 362/103 |
| 3,900,725 | 8/1975 | Komon | 240/7.5 |
| 4,328,533 | 5/1982 | Paredes | 362/108 |
| 4,344,065 | 8/1982 | Erwin et al. | 340/984 |
| 4,673,366 | 6/1987 | Hawkins | 441/90 |
| 4,745,530 | 5/1988 | Farrell, Jr. et al. | 362/226 |
| 4,871,996 | 10/1989 | Tsunamoto et al. | 340/573 |
| 4,891,736 | 1/1990 | Gouda | 362/105 |
| 5,029,293 | 7/1991 | Fontanille | 340/573 |
| 5,070,436 | 12/1991 | Alexander et al. | 362/103 |
| 5,083,956 | 1/1992 | Chraghchian et al. | 441/89 |
| 5,207,500 | 5/1993 | Rios et al. | 340/475 |
| 5,370,566 | 12/1994 | Mitchell, Jr. et al. | 441/89 |

FOREIGN PATENT DOCUMENTS

| | | | |
|---|---|---|---|
| 0002622 | 6/1979 | European Pat. Off. | 340/984 |
| 207879 | 11/1979 | German Dem. Rep. . | |
| 8503106 | 11/1985 | Netherlands . | |
| 104983 | 3/1917 | United Kingdom . | |
| 0373109 | 11/1930 | United Kingdom | 441/89 |
| 648308 | 1/1951 | United Kingdom . | |
| 9002906 | 3/1990 | WIPO | 362/108 |

OTHER PUBLICATIONS

*Safe Boating Hints for Personal Watercraft,* California Department of Boating and Waterways, 1993.

*Navigation Rules International–Inland,* U.S. Department of Transportation United, States Coast Guard, 1992, p. 49.

*Product Evaluation Troy Lee Designs,* Splash, Aug. 1994, p. 46.

*Primary Examiner*—Brent A. Swarthout
*Attorney, Agent, or Firm*—Christie, Parker & Hale

[57] ABSTRACT

A navigation lights device comprises red, green, and white navigation lights attached to the top of a left shoulder portion, a right shoulder portion, and a back side portion, respectively, of a buoyant vest or harness worn over the upper body of a person. A battery pack can be attached to the vest to provide electrical power to the navigation lights via wires that extend therebetween. The navigation lights device can be permanently attached to the vest or can be releasably attached. The navigation lights device also comprises headgear or a helmet that is worn over a top portion of a person's head and includes red, green, and white navigation lights attached to a left side portion, right side portion, and back side portion, respectively, of the headgear. The headgear can include a battery pack attached to the headgear to provide electrical power to the navigation lights via wires that extend therebetween.

16 Claims, 8 Drawing Sheets

NAVIGATION LIGHTS FOR PERSONAL WATERCRAFT OPERATOR

FIELD OF THE INVENTION

This invention relates to navigational lighting used with power-driven vessels and, more particularly, to navigational lighting worn by an operator of a personal watercraft.

BACKGROUND OF THE INVENTION

The Navigational Rules of the U.S. Coast Guard require that power-driven vessels be equipped with one form or another of navigational lighting if they are to be operated at night or at other times of reduced visibility. The form of navigation lighting that is typically required includes a red colored light positioned at the left or port side of the vessel, a green colored light positioned at the right or starboard side of the vessel, and a white colored light attached to the rear or stern of the vessel. The uniform use of these differently colored lights at each designated position by power-driven vessels enhances navigational safety at night, or at other times of reduced visibility, because upon viewing a vessel equipped with such navigational lights one can immediately ascertain the direction of the vessel and get a good idea of the vessel size. Accordingly, from this information an operator of an adjacent vessel can take whatever corrective navigational measure that may be called for to stay clear of the lighted vessel.

Recreational watercraft have gained popularity in recent years and, in particular, personal watercraft have become increasingly popular. Personal watercraft are sometimes referred to by their trade names such as the Jet Ski® by Kawasaki and the WaveRunners® by Yamaha, and are typically power-driven vessels configured to accommodate one or two riders that take a straddled seated position on the watercraft much like a rider of a bicycle or motorcycle. The rider of such watercraft controls the steering and speed of the craft by use of a handlebar type control arrangement. The personal watercraft are popular because of their easy maneuverability, ease of transportation, low cost, and because they are capable of being operated at a high rate of speed.

Personal watercraft of the type described above, although being power-driven vessels, are not equipped with navigational safety lights. Accordingly, owners and users of such personal watercraft are limited to daytime or times of good visibility only for use of the watercraft. Night time use of the watercraft, for example, is in violation of the Navigation Rules of the U.S. Coast Guard so that violators can be ticketed and fined, and is extremely risky due to the high speed at which such personal watercraft are capable of being operated, and the limited protection that the watercraft itself offers its rider. As a result, almost any type of collision with such personal watercraft can result in serious injury to the driver and any rider. For this reason, the California Department of Boating and Waterways has issued a Boating Safety booklet for personal watercraft requiring that operators of personal watercraft "never ride between sunset and sunrise or at any other time of reduced visibility." Nonetheless, personal watercraft operators may disregard safety considerations or may find themselves forced to operate at a time of reduced visibility.

It is, therefore, desirable to provide navigational lights on such watercraft in a manner that will further the purpose of the Navigation Rules of the U.S. Coast Guard in providing visible navigation information at night or reduced visibility times. Because of the size, configuration, and placement of the driver and/or riders of such personal watercraft, the driver and/or riders tend to take a predominate position of high visibility on the watercraft. Therefore, it is desirable to equip a driver and/or rider of such personal watercraft with such navigational lights in a manner that is non-intrusive and will not interfere with the operation and enjoyment of the personal watercraft.

The use of attaching an illuminating light to a lifejacket for purposes of locating a person that has fallen or is otherwise in need of rescue from the ocean is disclosed in U.S. Pat. Nos. 5,083,959, 4,673,366, 3,621,501, and 2,361,414, and in British Patent Nos. 648,308, 373,109, and 104,963. Each of these patents are directed to a lifejacket that includes inter alia a warning, locating, or distress beam for directing a rescuing party to a lifejacket wearing individual who has fallen into the ocean or other body of water, or who may be adrift in a lifeboat, for identification and rescue. Such illuminating lights may be activated by the individual in distress, or may be activated automatically. U.S. Pat. No. 5,029,293 is directed to a helmet including a flashing lamp mounted at the top of the helmet for use in locating an individual that has fallen into the sea.

The use of reflectors on headgear or a helmet that is to be worn by a person operating personal watercraft is known. Such reflectors may provide means of identifying or locating a person on an ocean or other body of water but only when a light beam is shined on the reflector. Some personal watercraft manufacturers have also incorporated the use of brightly colored surfaces in the design of their vessel. For example, one personal watercraft manufacturer employs a brightly colored surface of one color on the top portion of an oil filler cap located on one side of the watercraft, and employs a brightly colored surface of a different color on the top portion of a gas filler cap located at an opposite side of the watercraft. The brightly colored caps may serve to identify the presence of a watercraft at night time or at times of reduced visibility but only when a light is shined on the surfaces. Primarily, the brightly colored caps serve to direct the watercraft operator to the proper oil and gas filling locations for refilling, so as to avoid contamination due to mistaking the caps for one another.

None of the above-identified uses address the need to equip a driver and/or rider of a personal watercraft with navigation lights to enhance night time navigational safety. Further, the use of reflectors or reflective surfaces on headgear or on the watercraft itself is a passive source of identification, and does not address the lack of active navigation lighting used in conjunction with such personal watercraft to permit safe and legal operation of the personal watercraft during night time or times of reduced visibility.

It is, therefore, desirable to construct a device that when worn will equip a watercraft driver and/or operator with navigation lights. It is desirable that the device be lightweight, easy to wear, and not interfere with the operation of the watercraft. It is desirable that the device be constructed in a manner that will not produce harm of electrical shock by contact and immersion with water.

SUMMARY OF THE INVENTION

There is, therefore, provided in practice of this invention a navigation lights device or system for use by a driver and/or rider of a personal watercraft. The navigation lights device comprises a buoyant vest, such as a lifejacket and the like, or comprises a lightweight harness that is worn over the upper body of a user. A red navigation light is attached to an upper left shoulder portion of the vest. A green navigation light is attached to an upper right shoulder portion of the vest. A white navigation light is attached to an upper back side surface of the vest between the red and green navigation lights. A battery pack can be attached to the vest to provide electrical power to the navigation lights via wires that extend therebetween. The navigation lights device can be permanently attached to the vest or can be releasably attached.

The navigation lights device may also comprise headgear or a helmet that is worn over a top portion of a person's head. The headgear comprises a red navigation light attached to a left side portion of the headgear. A green navigation light is attached to a right side portion of the headgear. A white navigation light is attached to a back side portion of the headgear. The headgear can comprise a battery pack attached to the headgear to provide electrical power to the navigation lights via wires that extend therebetween.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
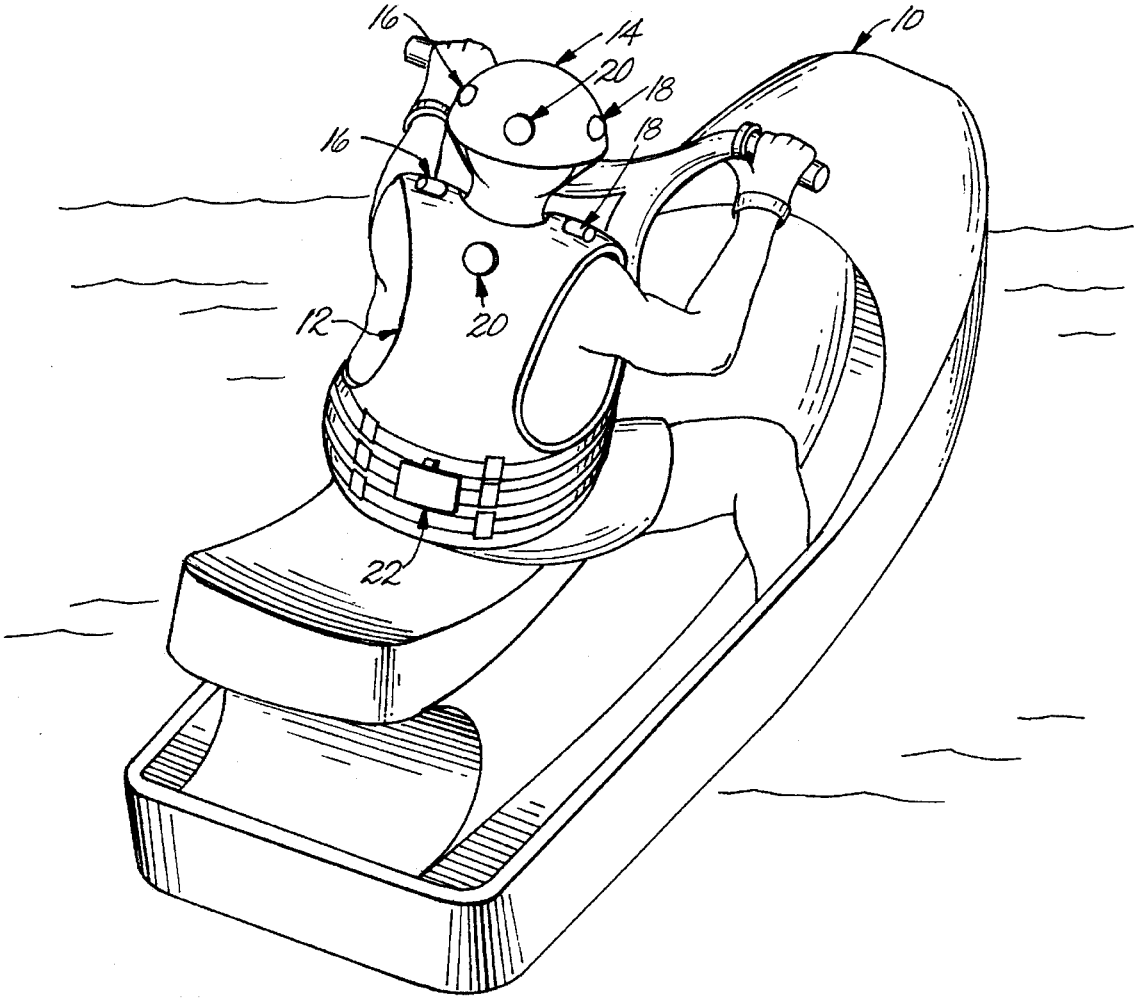
FIG. 1 is a perspective view of a person driving a personal watercraft wearing a navigation lights device constructed according to principles of this invention.

FIG. 1 illustrates a person driving a personal watercraft 10 wearing a navigation lights device in the form of a lifejacket 12 and headgear 14 comprising red 16, green 18 and white 20 navigation lights attached to the left, right and back side, respectively, of the lifejacket and headgear, and a battery pack 22 attached to the lifejacket for providing electrical power thereto.

Figure 2A:
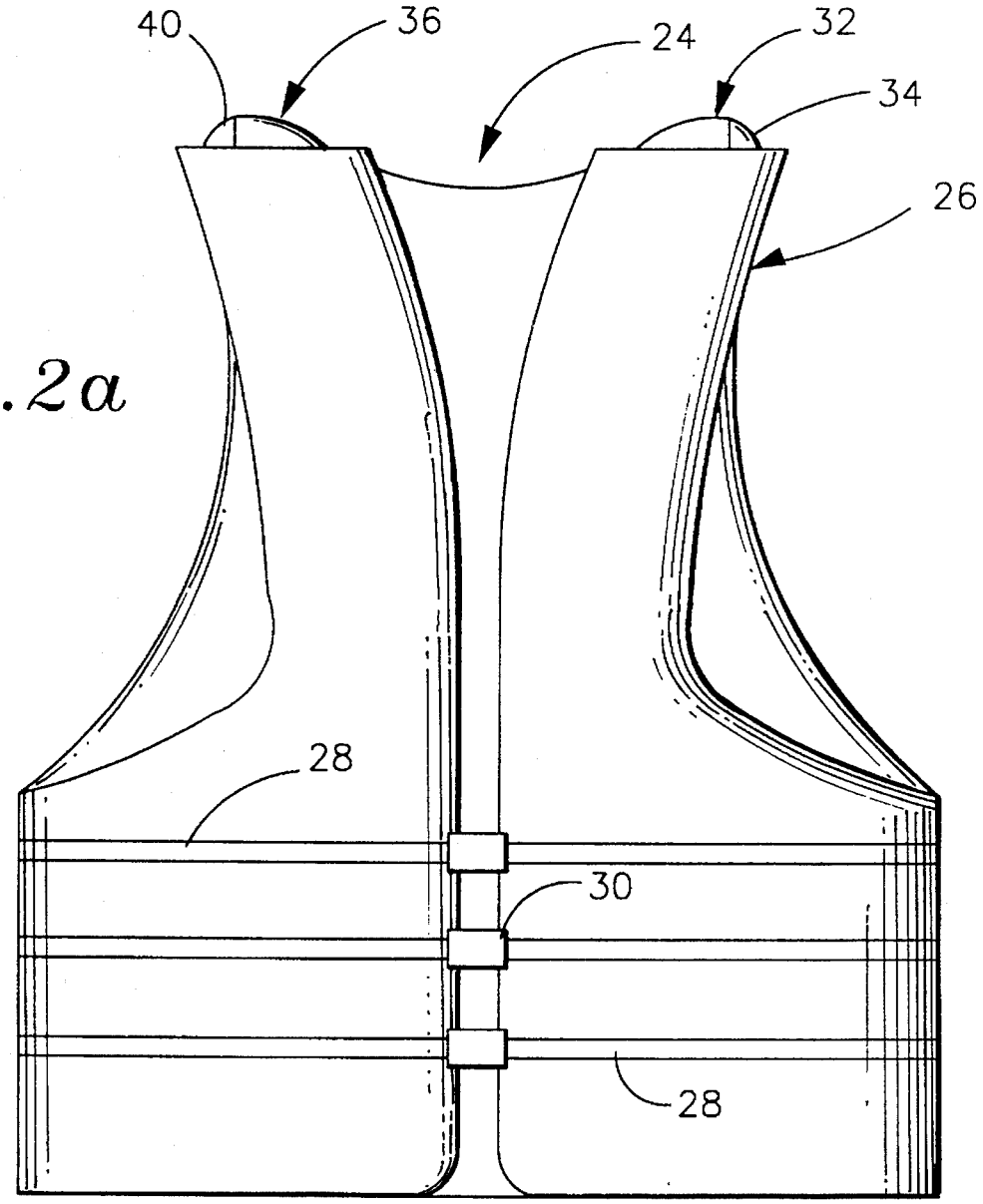
FIG. 2*a* is a front elevational view of a preferred embodiment of a navigation lights lifejacket constructed according to principles of this invention.
Figure 2B:
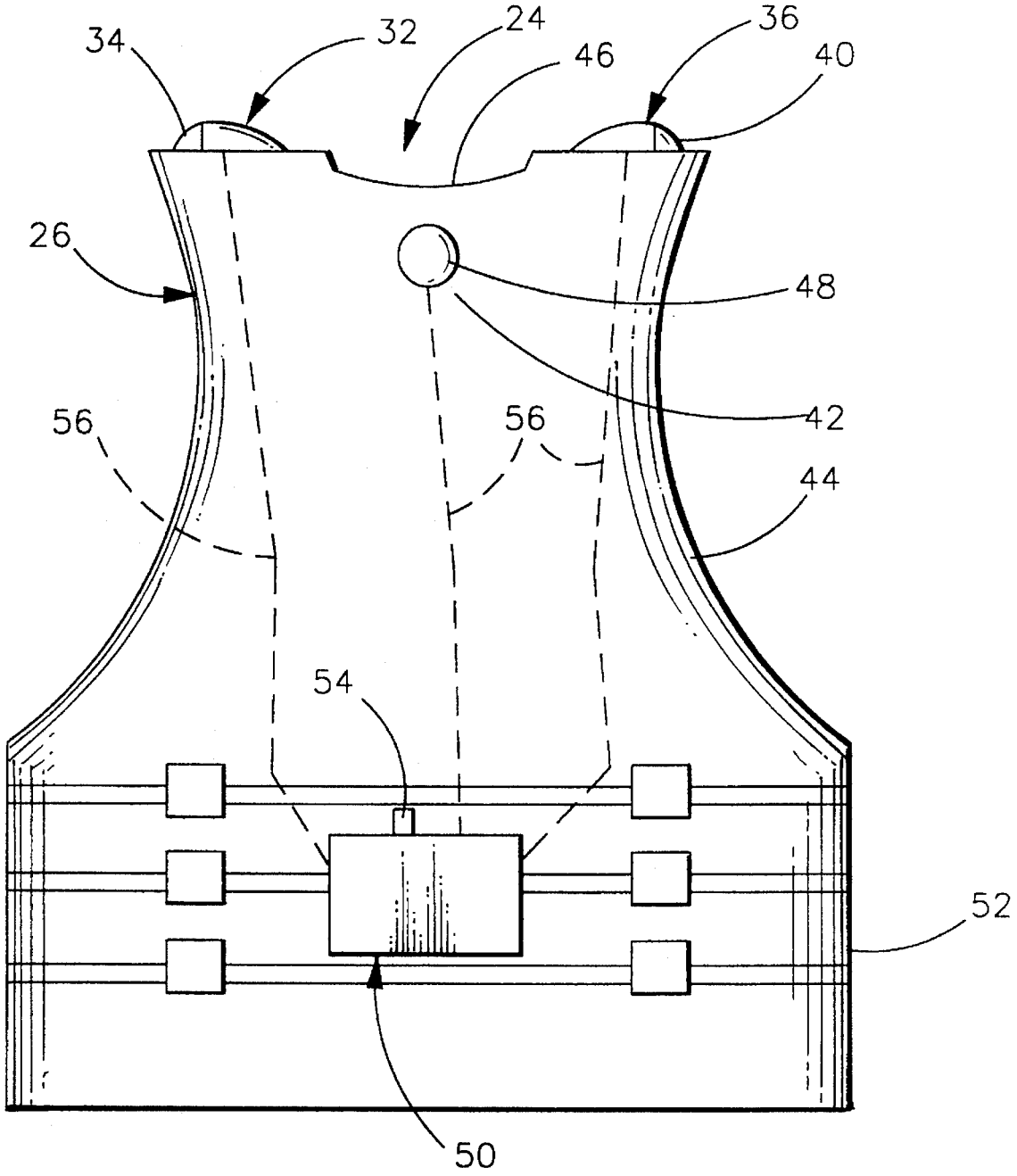
FIG. 2*b* is a back elevational view of the preferred embodiment of the navigation lights life jacket of FIG. 2*a;*

FIGS. 2*a* and 2*b* illustrate a first preferred embodiment of the navigation lights device 24 that includes a lifejacket 26 of conventional construction that is made from a buoyant material such as foam and the like. It is desirable that the lifejacket be of the type typically worn by personal watercraft drivers and riders, having large openings for the arms so that wearing the device will not impair the operation of the watercraft. The lifejacket includes straps 28 near a lower portion of the jacket, which is worn around the chest or waist of the user. The straps 28 are fastened together by conventional fastening means 30 such as by buckle or Velcro fasteners to secure the lifejacket around the user and to provide adjustment of fit to accommodate users of different size.

Referring to FIG. 2*a*, a red colored navigation light 32 is attached to the top of a left shoulder portion 34 of the jacket 26. The navigation light 32 is of conventional construction and includes a lamp configured to provide a predetermined amount of illumination. The navigation light 32 may be constructed having a red colored lens and a conventional light bulb, or may have a clear lens and a red colored light bulb. It is desired that the navigation light be both shockproof and waterproof. In a preferred embodiment, the red colored navigation light 32 includes a red colored lens 34 and a conventional non-colored light bulb (not shown).

A green colored navigation light 36 is attached to the top of a right shoulder portion 38 of the jacket 26. The navigation light 36 is configured in the same manner as previously described for the red colored navigation light 32. In a preferred embodiment, the green colored navigation light 36 includes a green colored lens 40 and a conventional non-colored light bulb (not shown).

Referring to FIG. 2*b*, a white colored navigation light 42 is attached to the back side 44 of the jacket 26 at the center of the jacket near a neck opening 46. The white colored navigation light 42 is configured in the same manner as that previously described for the red and green colored navigation lights 32 and 36, respectively. In a preferred embodiment, the white colored navigation light includes a white colored or clear lens 48 and a non-colored light bulb (not shown).

Referring still to FIG. 2*b*, a battery pack 50 is attached to the back side 44 of the jacket 26 about a waist portion 52. The battery pack is configured to accommodate batteries (not shown) that provide a low voltage electrical power to the red, green and white colored navigation lights. In a preferred embodiment, the battery pack is configured to provide a low voltage of approximately 12 volts or less to the navigation lights. It is desired that the battery pack be water tight so that the batteries contained within the pack will not be exposed to contact with water, thereby precluding the possibility of electrical short circuit between the battery terminals. The battery pack includes an on/off switch 54 for switching on or off the electrical power directed to the navigation lights. Alternatively, the battery pack 50 can be configured having a photoelectric cell and the like to provide automatic activation of the navigation lights in low light conditions, e.g., night time or reduced visibility.

The battery pack can also be configured having electrical circuitry and a manual switch that allows the user to manually change the operation of the navigation lights from continuous operation to flashing or pulsing operation. Alternatively, the battery pack can be configured having electrical circuitry that automatically changes the operation of the navigation lights from continuous operation to flashing or pulsing operation upon immersion of the lifejacket into the water. The ability to convert continuous operation to pulsed action is desirable, for example, to attract the attention of nearby boaters and the like that the user has fallen from the watercraft and is in the water. Accordingly, the use of a pulsed lighting system operates to warn other boaters and the like to stay clear of the fallen user.

Electrical power from the battery pack is routed in parallel to the red, green and white colored navigation lights via insulated wires 56 that extend from the battery pack to each navigation light. In a preferred embodiment, the wires 56 are attached or otherwise integrated into the lifejacket (as shown in FIG. 2*b*) in a suitable manner so as to avoid damage or entanglement.

The navigation lights device 24 is operated by placing the lifejacket 26 over a user's body, securely fastening the jacket to the user's body by use of the straps 28 and fasteners 30, and switching the switch 54 to the on position to activate the red, green and white colored navigation lights 32, 36 and 42, respectively.

Figure 3A:
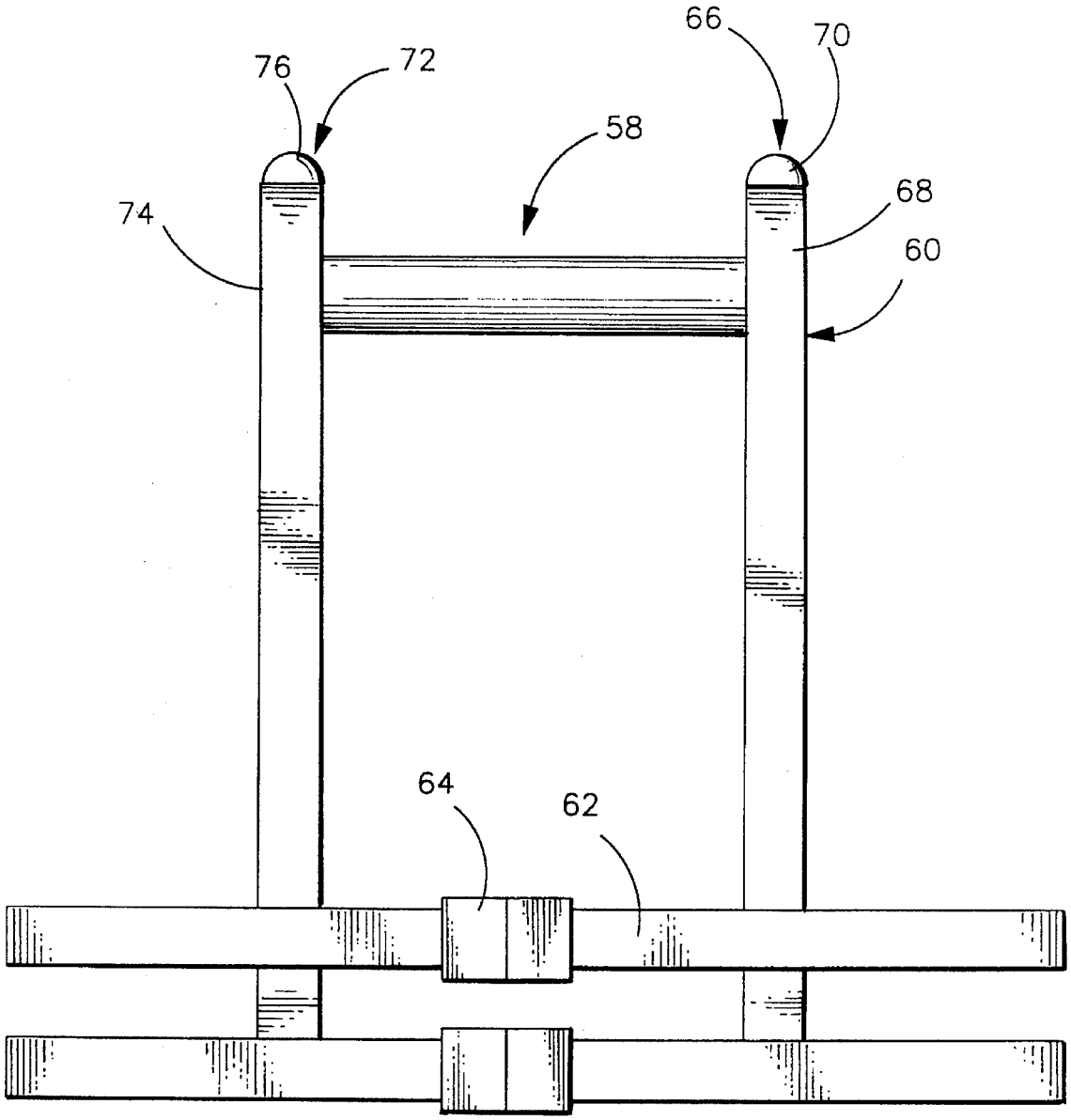
FIG. 3*a* is a front elevational view of a preferred embodiment of a navigation lights harness constructed according to principles of this invention.
Figure 3B:
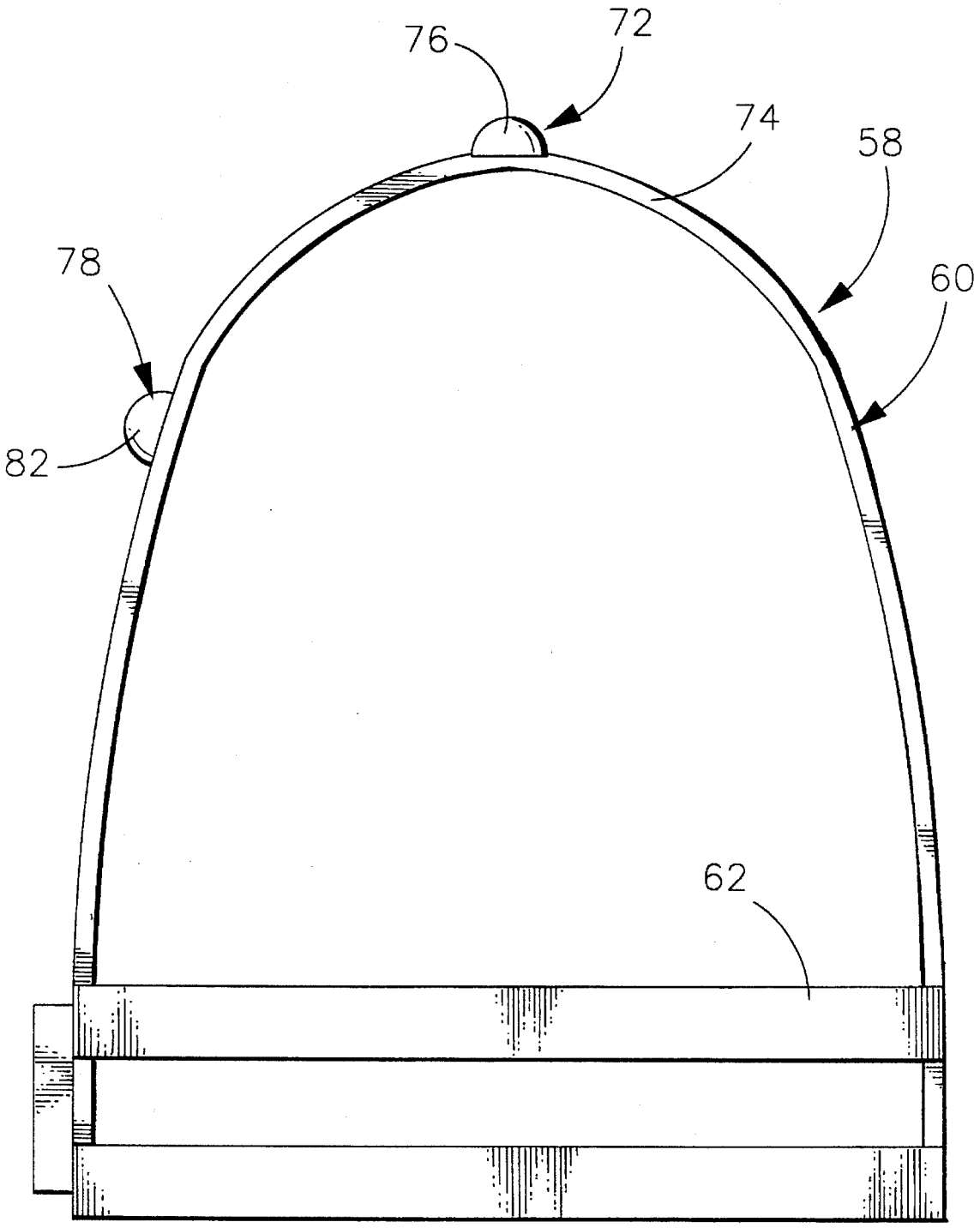
FIG. 3*b* is a side elevational view of the preferred embodiment of a navigation lights harness of FIG. 3*a;*
Figure 3C:
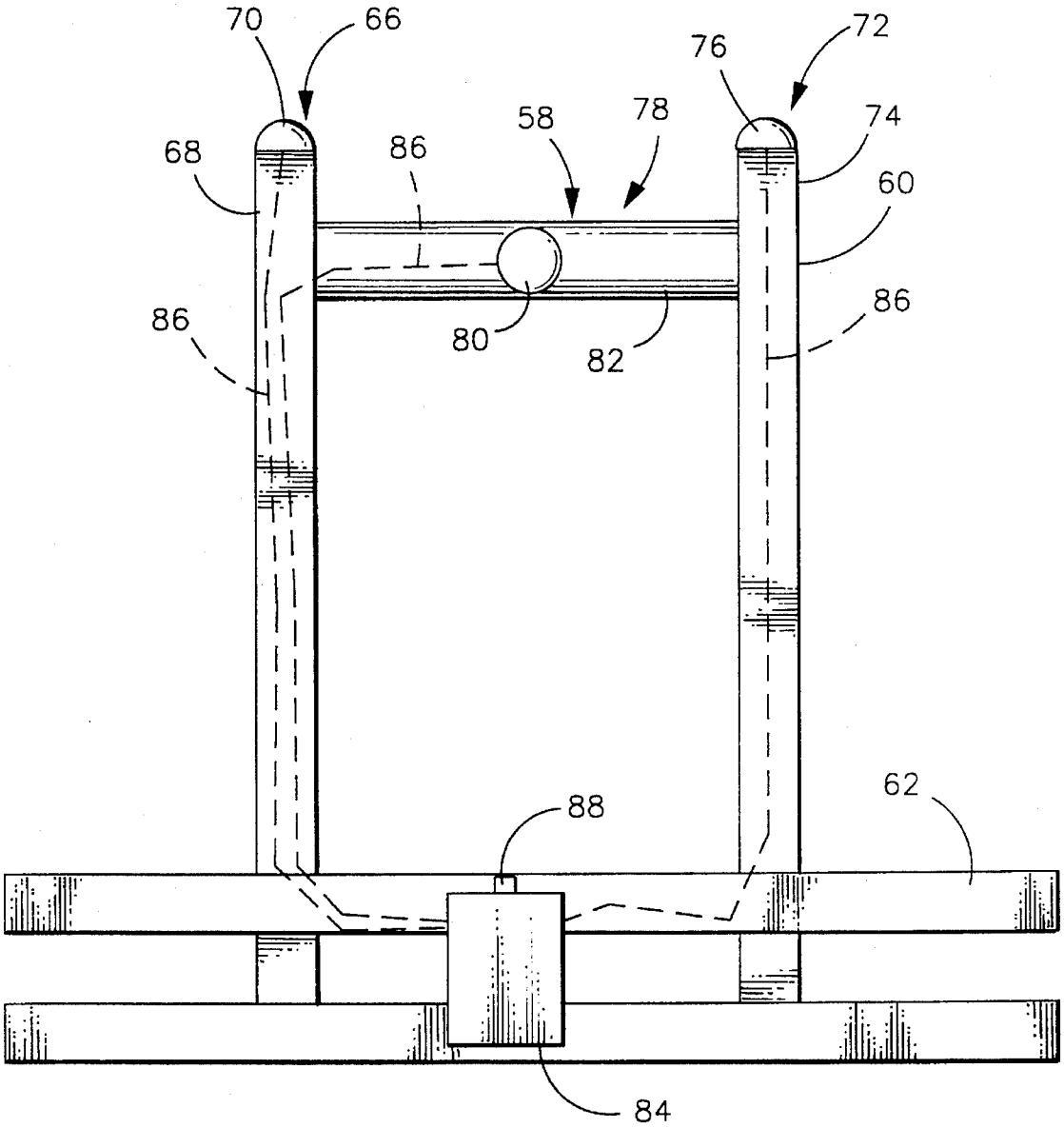
FIG. 3*c* is a back elevational view of the preferred embodiment of a navigation lights harness of FIG. 3*a;*

FIGS. 3*a*, 3*b* and 3*c* illustrate a second preferred embodiment of the navigation lights device 58 that includes a harness 60 that can be worn over the top of a lifejacket or buoyant vest and the like. The harness 60 can be worn by a driver or rider of a personal watercraft that already owns a conventional lifejacket but wishes to wear the harness over their own lifejacket to take advantage of the navigation lighting features of this invention. Like the lifejacket, the harness includes straps 62 and fasteners 64 attached around a lower portion of the harness to secure the harness about the chest or waist of a user. The fastener can be a conventional snap-lock type plastic fastener such as that made by National Molding of Farmingdale, N.Y. and sold under the trade name Side Squeeze™. The harness straps 62 can be made from nylon webbing or belts and the like stitched or sewn together for purposes of providing good weather resistance, strength, and for providing a harness having reduced weight.

Referring to FIG. 3*a*, the harness 60 includes a red colored navigation light 66 attached to the top of a left shoulder portion or strap 68 of the harness 60. The navigation light 66 is of the same construction as the navigation lights previously described in the first preferred embodiment 24. In a preferred embodiment, the red colored navigation light 66 includes a red colored lens 70 and a conventional non-colored light bulb (not shown).

A green colored navigation light 72 is attached to the top of a right shoulder portion or strap 74 of the harness 60. The navigation light 72 is of the same construction as the navigation lights previously described in the first preferred embodiment 24. In a preferred embodiment, the green colored navigation light 72 includes a green colored lens 76 and a conventional non-colored light bulb (not shown).

Referring to FIGS. 3*b* and 3*c*, a white colored navigation light 78 is attached to an upper back strap 80 of the harness 60 between the left and right shoulder portions 68 and 74, respectively. The white colored navigation light 78 is configured in the same manner as that previously described in the first preferred embodiment. In a preferred embodiment, the white colored navigation light 78 includes a white colored or clear lens 82 and a non-colored light bulb (not shown).

Still referring to FIGS. 3*b* and 3*c*, a battery pack 84 is attached onto straps 62 at the back side 80 of the harness. The battery pack 84 is of the same configuration as previously described in the first embodiment and supplies electrical power in parallel to each of the red, green and white colored navigation lights 66, 72 and 78 respectively. Insulated wires 86 are used to route electrical power from the battery pack 84 to the navigation lights and are attached to or integrated into the construction of the harness 60 to avoid damage or entanglement. The battery pack 84 includes an on/off switch 88 for switching electrical power to the navigation lights on or off.

The navigation lights device 58 is operated by placing the harness 60 over a lifejacket or over a user's upper body without a lifejacket, securely fastening the harness to the lifejacket and/or body of the user by use of the straps 62 and fasteners 64, and turning the switch 88 to the on position to activate the red, green and white colored navigation lights 66, 72 and 78, respectively.

Figure 4A:
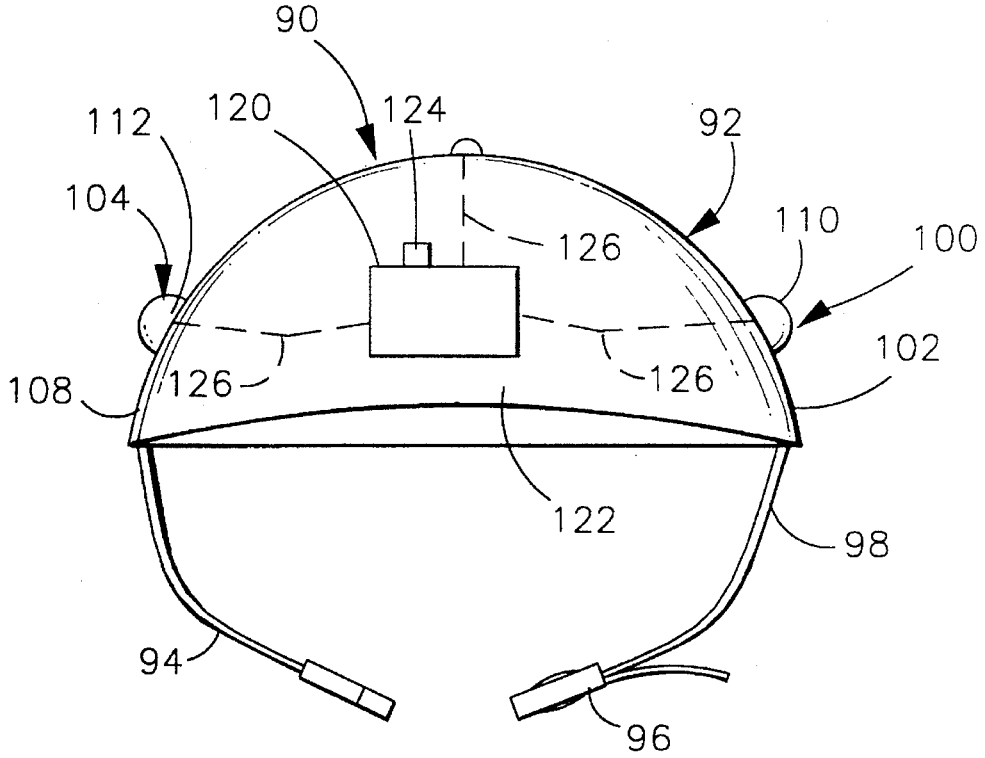
FIG. 4*a* is a front elevational view of a navigation lights headgear constructed according to principles of this invention.
Figure 4B:
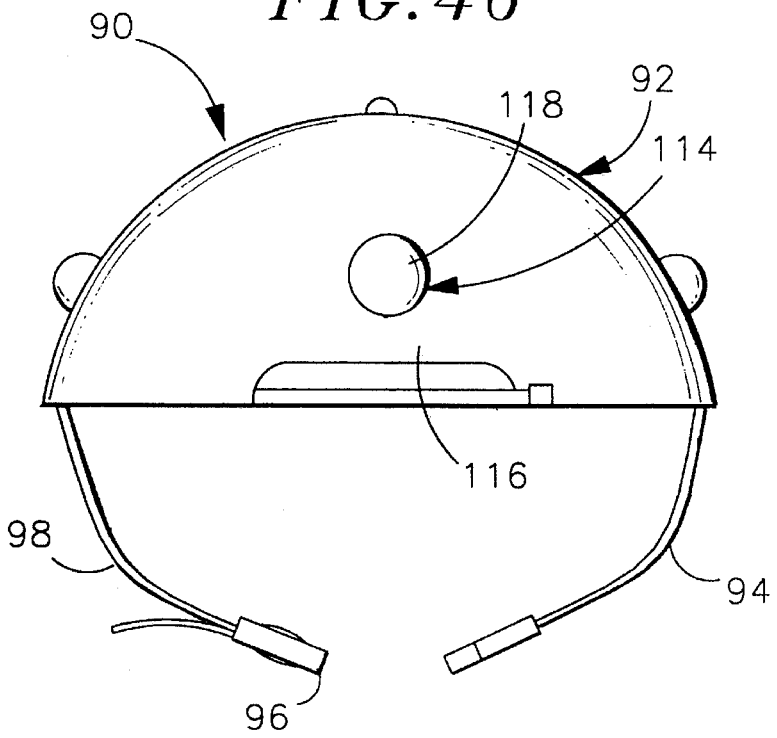
FIG. 4*b* is a back elevational view of the navigation lights headgear of FIG. 4*a*.

FIGS. 4*a* and 4*b* illustrate a preferred embodiment of a navigation lights device 90 that is worn over the top of a user's head and includes a headgear or a helmet 92. The type of headgear may include conventional types of protective head wear that can be worn over a person's head for purposes of avoiding or minimizing the extent of a head injury, such as foam constructed head wear commonly used in association with bicycle riding or mountain bike riding and the like. Additionally, the type of helmet may include a full face helmet as well as types of conventional helmets that do not afford face protection. Accordingly, it is to be understood that the headgear 92 illustrated in FIGS. 4*a* and 4*b* is provided for purposes of reference and clarity and is not intended to depict a particular type or design of headgear or helmet. Therefore, it is to be understood within the scope of this invention that the navigation lights device 90 as constructed according to principles of this invention may be used with all types of headgear and/or helmets.

Referring to FIG. 4*a*, the headgear 92 includes a strap 94 of woven nylon or the like that extends downwardly from the headgear and a fastener 96 of conventional design, attached to a second strap 98 also of woven nylon or the like extending from an opposite side of the headgear, that are fastened together beneath a user's chin to secure the headgear onto the user's head. A red colored navigation light 100 is attached to a left side portion 102 of the headgear, and a green colored navigation light 104 is attached to a right side portion 108 of the head gear. The red and green colored navigation lights are configured in the same manner as that previously described in the first and second embodiments 24 and 58, respectively. In a preferred embodiment, the red navigation light 100 includes a red lens 110 and a clear light bulb (not shown) and the green navigation light includes a green lens 112 and a clear light bulb (not shown).

Referring to FIG. 4*b*, the headgear 92 includes a white colored navigation light 114 attached to a back side 116 of the headgear. The white colored navigation light 114 is configured in the same manner as that previously described in the first and second embodiments. In a preferred embodiment, the white colored navigation light 114 includes a white colored or clear lens 118 and a clear light bulb (not shown).

Referring to FIG. 4*a*, the headgear 92 includes a battery pack 120 attached to a front side 122 of the headgear 92 between the red and green colored navigation lights. The battery pack 120 is of the same configuration as that previously described for the first and second embodiments adapted for mounting on the headgear, and includes an on/off switch 124 for turning on and off the electrical power to the red, green and white colored navigation lights 100, 104, and 114, respectively. Insulated wires 126 are used to route electrical power from the battery pack in parallel flow to each of the navigation lights, and are attached to or integrated into the construction of the headgear to avoid damage or entanglement.

The navigation lights device 90 is operated by placing the headgear 92 over the top of a user's head, securely fastening the headgear to user's head by the use of the strap 94 and fastener 96, and switching the switch 124 to the on position to activate the red, green and white colored navigation lights 100, 104 and 114, respectively.

Figure 5:
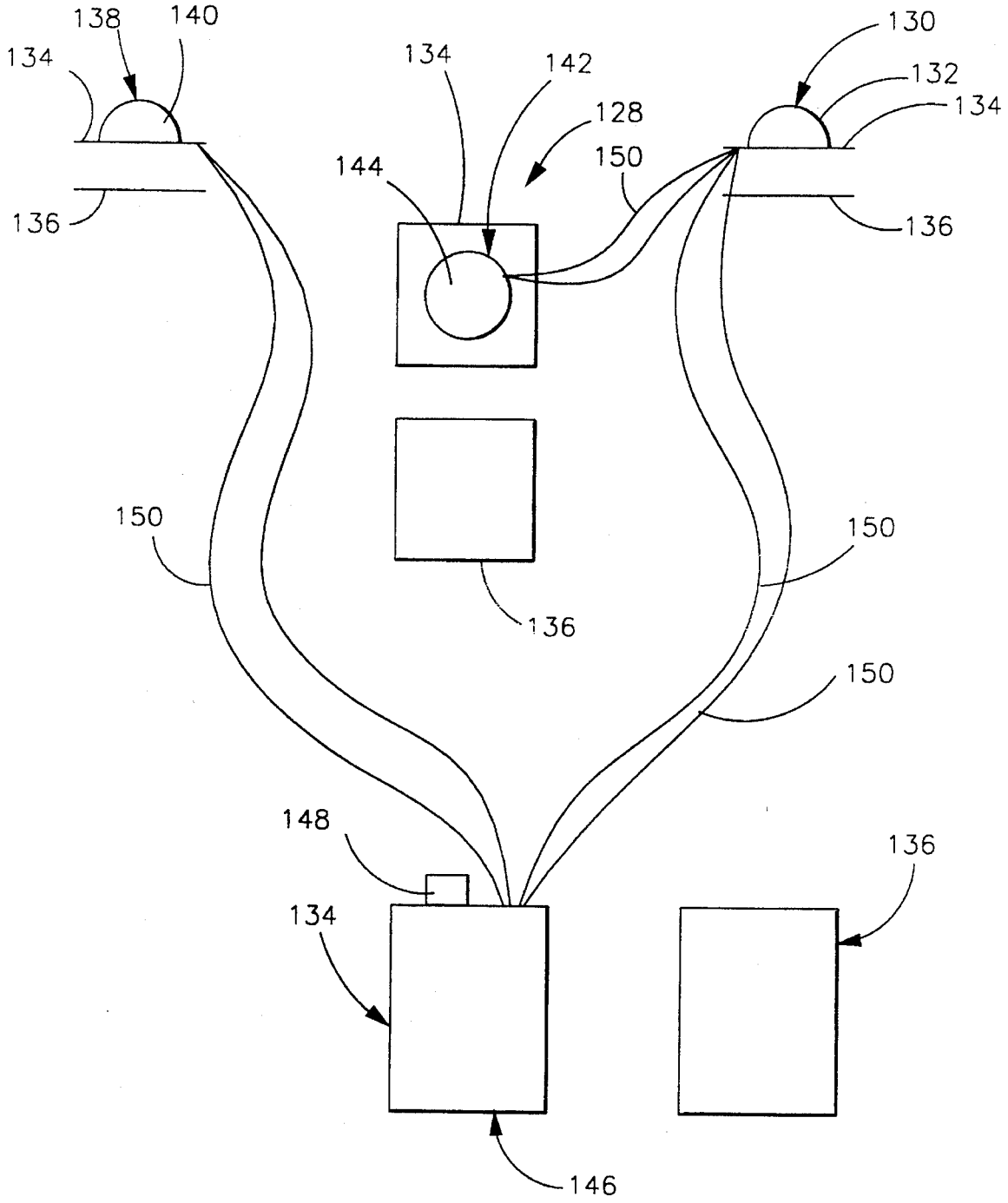
FIG. 5 is a front elevational view of a detachable navigation lights device constructed according to principles of this invention.

FIG. 5 illustrates a preferred embodiment of a detachable navigation lights device 128 that can be worn over a lifejacket, harness, or any other type of clothing article worn by a personal watercraft driver or rider. In a preferred embodiment, the detachable navigation lights device 128 is worn over a lifejacket or other buoyant vest. The detachable navigation lights device includes a red colored navigation light 130 that is releasably attached to a left shoulder portion of the underlying lifejacket. The red colored navigation light 130 is constructed in the same manner at that previously described for the first and second embodiments. In a preferred embodiment, the red colored navigation light includes a red lens 132 and a clear light bulb (not shown).

The red colored navigation light includes an attachment surface 134 that is configured to provide removable attachment with a complementary attachment surface 136 fixed to the surface of the underlying lifejacket at the top of the left shoulder portion. Cooperation between complementary attachment surfaces 134 and 136 forms a releasable fastening system for mounting the navigation light. The fastening system can be formed by attachment surfaces that incorporate use of quick disconnecting or releasing fasteners such as Velcro, snaps, zippers and the like.

The detachable navigation lights device includes a green colored navigation light 138 that is releasably attached to a right shoulder portion of the underlying lifejacket. The green colored navigation light 138 is constructed in the same manner as that previously described for the first and second embodiments. In a preferred embodiment, the green colored navigation light includes a green lens 140 and a clear light bulb (not shown). Like the red colored navigation light 132, the green colored navigation light 138 also includes an attachment surface 134 that is configured to provide releasable attachment with a complementary attachment surface 136 fixed to the top of the underlying lifejacket at the right shoulder portion.

The detachable navigation lights device 128 includes a white colored navigation light 142 that is releasably attached to an upper backside surface of an underlying lifejacket near a neck opening. The white colored navigation light 142 is constructed in the same manner as that previously described for the first and second embodiments. In a preferred embodiment, the white colored navigation light includes a white colored or clear lens 144 and a clear light bulb (not shown). Like the red and green colored navigation lights, the white colored navigation light 142 also includes an attachment surface 134 that is configured to provide releasable attachment with a complementary attachment surface 136 fixed to the upper backside surface of the underlying lifejacket.

The red, green and white colored navigation lights are electrically connected in parallel to a battery pack 146 of the same construction previously described in the first and second embodiments. The battery pack 146 is releasably attached to a lower portion of a back side surface of the underlying lifejacket via cooperating attachment surfaces 134 and 136. The battery pack 146 includes an on/off switch 148 to turn on or off electrical power from the battery pack to the navigation lights.

The red, green and white colored navigation lights 130, 138 and 142, respectively, are attached to the battery pack 146 by insulated wires 150 that extend from the battery pack to each respective navigation light. The wires can be temporarily fastened to the underlying lifejacket by use of duct tape, ties, Velcro straps or other suitable fastening means to ensure that they are not damaged or become entangled during operation of the personal watercraft.

The detachable navigation lights device 128 is operated by attaching the attachment surface 134 of the battery pack 146 to a corresponding attachment surface 136 fixed to the underlying lifejacket or other suitable vest, attaching the attachment surfaces 134 of the red, green and white colored navigation lights 130, 138 and 142, respectively, with respective attachment surfaces 136 of the underlying lifejacket, and switching the on/off switch 148 to the on position to activate the red, green and white colored navigation lights.

Although limited embodiments of a navigation lights device have been described and illustrated herein, many modifications and variations will be apparent to those skilled in the art. For example, the navigation lights device may be configured without a battery pack, and instead be configured having an electrical connector that attaches to an electrical outlet in the personal watercraft. In such an alternative embodiment, the red, green and white colored navigation lights are powered by a low voltage electricity provided by the watercraft itself. This would be advantageous since it eliminates the need for a personal watercraft driver and/or rider to wear a battery pack. Accordingly, it is to be understood that, within the scope of the appended claims, the navigation lights device constructed according to principles of this invention may be embodied other than as specifically described herein.

What is claimed is:

1. A navigation lights device comprising:

a buoyant vest adapted to be worn by a person on a personal watercraft;

a red colored navigation light attached to an upper left shoulder portion of the vest; and a green colored navigation light attached to an upper right shoulder portion of the vest; and a white or clear colored navigation light attached to an upper back side surface of the vest between the first and second navigation lights, wherein an observer located behind a person wearing the vest is able to ascertain from the position of the navigation lights with respect to each other the direction of movement of the watercraft.

2. The navigation lights device as recited in claim 1 further comprising means for providing electric power to activate the navigation lights.

3. The navigation lights device as recited in claim 2 wherein the means for providing electric power is attached to the vest.

4. The navigation lights device as recited in claim 3 wherein the means for providing electric power comprises a battery pack and wires that extend from the battery pack to each of the navigation lights, forming an electrical circuit therebetween.

5. The navigation lights device as recited in claim 4 wherein the battery pack includes a manually operated on/off switch for turning on or off electrical power to the navigation lights.

6. The navigation lights device as recited in claim 4 wherein the battery pack includes an electronic circuit that automatically activates the navigation lights in a low light condition.

7. The navigation lights device as recited in claim 4 wherein the battery pack includes a manually operated circuit that converts operation of the navigation lights from continuous operation to pulsing operation.

8. The navigation lights device as recited in claim 4 wherein the battery pack includes electronic circuitry that automatically converts operation of the navigation lights from continuous operation to pulsing operation upon immersion of the vest into water.

9. The navigation lights device as recited in claim 1 wherein the navigation lights are releasably attached to respective portions of the vest.

10. The navigation lights device as recited in claim 1 further comprising headgear that is worn over a top portion of a person's head, wherein the head gear comprises:

a red navigation light positioned at a left side surface of the headgear;

a green navigation light positioned at a right side surface of the headgear; and a white or clear navigation light positioned at a back side surface of the headgear.

11. The navigation lights device as recited in claim 10 wherein the headgear includes a battery pack attached to a front side surface of the headgear and electrically connected to each of the navigation lights on the headgear by wires.

12. A navigation lights device adapted to be worn by a person on a personal watercraft comprising:

a red colored navigation light including an attachment for providing releasible attachment with a complementary attachment on an upper left shoulder portion of an underlying buoyant vest;

a green colored navigation light including an attachment for providing releasible attachment with a complementary attachment on an upper right shoulder portion of the vest; and a white or clear navigation light including an attachment for providing releasible attachment with a complementary attachment on an upper back side portion of the vest, wherein an observer located behind a person wearing the vest is able to ascertain from the position of the navigation lights with respect to each other the direction of movement of the watercraft.

13. The navigation lights device as recited in claim 12 comprising a battery pack including an attachment for providing releasible attachment with a complementary attachment on a portion of the vest, wherein wires electrically connect the battery pack to each navigation light.

14. A navigation lights device that is worn by a person on a personal watercraft comprising:

a buoyant vest;

a red navigation light attached to an upper left shoulder portion of the vest;

a green navigation light attached to an upper right shoulder portion of the vest;

a white navigation light attached to an upper back side surface of the vest between the red and green navigation lights; and a battery pack attached to a portion of the vest for providing electrical power to each of the navigation lights, wherein wires extend from the battery pack to each of the navigation lights to provide electrical connection therebetween, wherein an observer located behind a person wearing the vest is able to ascertain from the position of the navigation lights with respect to each other the direction of movement of the watercraft.

15. The navigation lights device as recited in claim 14 wherein the battery pack includes a switch for turning on or off electrical power to each of the navigation lights.

16. The navigation lights device as recited in claim 14 wherein the battery pack includes electrical circuitry that converts operation of the navigation lights from continuous operation to pulsing operation.

* * * * *